US005150789A

United States Patent [19]

Bass

[11] Patent Number: 5,150,789

[45] Date of Patent: Sep. 29, 1992

[54] PACKAGE OF ELONGATED STRAND MATERIAL AND CARTON BLANK THEREOF

[75] Inventor: Benjamin A. Bass, Omaha, Nebr.

[73] Assignee: AT&T Bell Laboratories, Murray Hill, N.J.

[21] Appl. No.: 649,084

[22] Filed: Jan. 31, 1991

[51] Int. Cl.[5] ..... B65D 85/04

[52] U.S. Cl. ..... 206/396; 206/409; 242/163

[58] Field of Search ..... 206/395, 396, 408, 409, 206/389; 242/163

[56] References Cited

U.S. PATENT DOCUMENTS

| | | | |
|---|---|---|---|
| 1,889,933 | 12/1932 | Pratt | 206/396 |
| 2,706,592 | 4/1955 | Schaller | 206/395 |
| 2,743,009 | 4/1956 | Williamson et al. | 206/396 |
| 2,860,773 | 11/1958 | Zackheim | 206/408 |
| 3,229,812 | 1/1966 | Metzger | 206/396 |
| 3,677,491 | 7/1972 | Gerwig | 206/409 |
| 3,689,005 | 9/1972 | Newman | 242/163 |
| 3,823,894 | 7/1974 | Frederick et al. | 242/137.1 |
| 3,877,661 | 4/1975 | Newman | 242/163 |
| 3,923,270 | 12/1975 | Newman et al. | 242/163 |
| 4,019,636 | 4/1977 | Wise | 206/409 |
| 4,122,949 | 10/1978 | Blatt | 206/303 |
| 4,160,533 | 7/1979 | Kotzur et al. | 206/397 |
| 4,817,796 | 4/1989 | Camillo et al. | 206/396 |

FOREIGN PATENT DOCUMENTS

| | | |
|---|---|---|
| 515914 | 12/1939 | United Kingdom . |
| 1325214 | 8/1973 | United Kingdom . |

*Primary Examiner*—Jimmy G. Foster
*Attorney, Agent, or Firm*—Edward W. Somers

[57] ABSTRACT

A package (20) from which elongated strand material (26) of a coil (24) is dispensed includes a carton (22) in which is disposed the coil. The carton is assembled from a blank (30) of corrugated fiberboard. The blank is formed to include a plurality of interconnected wall panels (32, 34, 36, 38) with each panel having closure flaps extending laterally from opposed side edge surfaces thereof. A tab extends laterally from each of the closure flaps. Each flap is attached hingedly to its associated wall panel and each tab is attached hingedly to its associated flap through a scored line. In end ones (56 and 67) of the closure flaps, portions of the closure flaps extend at least to free outer end edge surfaces of the associated tabs and are normal to end edge surfaces of the blank.

23 Claims, 3 Drawing Sheets

PACKAGE OF ELONGATED STRAND MATERIAL AND CARTON BLANK THEREOF

TECHNICAL FIELD

This invention relates to a package of coiled, elongated strand material and a carton blank thereof. More particularly, the invention relates to a package of strand material such as communications wire, the package including a corrugated fiberboard carton which has been assembled from a blank having a configuration which facilitates its manufacture.

BACKGROUND OF THE INVENTION

It is customary in the communications industry to provide coils of strand material, which is referred to as wire and which typically includes a relatively small number of transmission media enclosed in a jacket, for installation purposes. Such a coil generally is provided in a container or carton which typically is made of corrugated fiberboard. The carton is used to prevent inadvertent unravelling of the coil of wire during storage and during handling.

In the prior art, there is disclosed a package comprising a carton and a coil of elongated strand material. The carton includes a pair of generally truncated conically shaped members, which are referred to as cones, projecting in opposite directions into a central open core of the coil of elongated strand material to provide support for the coil during handling and while the package of wound material is being unwound. The use of cones extending into the central core space of the wound strand material also prevents the loops of the strand material from becoming entangled during unwinding of the material from the carton.

Strand material, beginning from the core of the coil, is drawn or payed out through a feed or payout tube extending radially through the loops of the coil and through a wall panel of the carton. Such a payout arrangement generally is referred to as inner end payout. The packaging of wound material in cartons for inner end payout is known to the art and such packages are often referred to as non-reel types.

Along with the increasing use of such strand material unwound by inner end payout, there has arisen a need to provide an improved carton both to support and protect the coil during handling and use. Also important is that the carton have sufficient strength and suitable configuration such that a plurality of such cartons can be stacked safely one upon the other without breakage of the carton or damage to the coils of strand material stored therewithin.

In the past, packages of the so-called non-reel types have included a conventional corrugated fiberboard carton having separate cones inserted into the center open core of the coil of strand material. Although separate cones also facilitate the unwinding of the strand material from the interior of the coil to the outside, it has been found that separate cone inserts complicate the packaging operation and increase the cost of the package.

In a more recently introduced package is disclosed a carton which package includes four wall panels which are joined end-to-end by hinge connections and which provide the perimeter of an assembled carton. Inner and outer closure flaps are hingedly connected to each of opposed side edges of the wall panels. Tabs are hinged to the center of a free side edge of each of the closure flaps, each of the tabs being generally tapered. Open ended slots are provided in the free end of each tab of two sets of the tabs which are associated with outer ones of the closure flaps. Each of the open ended slots extends from a free edge of its associated tab to a point spaced from a line of connection of the tab to its adjacent associated outer closure flap. Internal slots are provided in the tabs which extend from the inner closure flaps. The internal slots also extend along the tabs but begin inwardly of the free ends of the tabs and extend across the lines of connection of the tabs to their adjacent associated inner closure flaps and terminate in these inner flaps. When the tabs extending from the inner closure flaps are folded along their connection lines, portions of the internal slots are located in the tabs and portions in the inner closure flaps.

In the assembly of the last mentioned carton, ends of end ones of the wall panels are attached together to provide a perimeter of the carton. Afterwards, two of the inner closure flaps are folded inwardly and tabs associated therewith abut each other as they are caused to project into the center of the volume defined partially by the four wall panels. Also portions of the internal slots which are disposed in the inner closure flaps are aligned. Then outer closure flaps and associated tabs are folded inwardly over the inner closure flaps. when a pair of the folded tabs of two of the outer closure flaps abut one another, they are inserted into the internal slots of the previously closed inner closure flaps. As aligned internal slots of each pair of abutting inner closure flaps receive abutting tabs of two outer closure flaps, walls which define the internal slots engage the outer walls of the abutting tabs. The tabs become interlocked in a perpendicular relationship with tabs associated with the inner closure flaps to form a cone extending inwardly of the carton. A package is formed by inserting a coil of strand material into the carton which is formed in such a manner that an open center portion of the coil is disposed over the cone. Then the inner and outer closure flaps which extend from opposite sides of the wall panels are folded over into a closed position. Another cone is formed and extends into the open core of the coil.

Several problems relating to the just-described package have surfaced. The carton is somewhat difficult to manufacture. Usually, a blank which has dimensions equal to those of the developed carton including the tabs is provided. Then the blank is cut by a punch and die apparatus to provide a planar, formed blank which includes wall panels and tabs extending therefrom. Afterwards, the blank is scored to provide hinged connections in the form of fold lines between wall panels and flaps and between the flaps and the tabs.

Because of the tabs extending from end ones of the wall panels in the blank, there are insufficient lengths of edge surfaces along outer edges of the flaps and panels to square-up accurately the formed blank for the scoring step. As a result, the carton which is assembled using those scored lines may be out of square. If so, such cartons are difficult to arrange in a stable stack. The scrap rate for blanks formed in this manner has been at an unacceptable level.

Also, because of a lack of tabs which lock positively within notches or slits, carton flaps are not adequately secured into desired positions. Hence, adhesively-backed tape needs to be applied across the flaps in order to maintain the configuration of the assembled carton subsequent to the insertion of the coil of strand material.

What is needed and what seemingly has not been provided by the prior art is a package including a carton which is easily manufactured with a scrap rate reduced substantially over that of the prior art and which in assembled form is stackable. Desirably, the sought after carton includes an improved locking arrangement which is effective to hold the carton together in its assembled, closed configuration without the use of tape. Also, the sought after carton should compare favorably with presently available cartons in cost and should provide at least all the features for the coil of strand material to be inserted therein as does the prior art carton.

SUMMARY OF THE INVENTION

The foregoing problems of the prior art have been overcome with the package of coiled, elongated strand material of this invention. The package includes a carton which preferably is made from corrugated fiberboard. The coil of strand material may comprise a plurality of convolutions or loops of a wire, for example, which includes a plurality of twisted pairs of insulated conductors and an enclosing jacket.

The carton is formed from a blank which includes four wall panels which are interconnected in end to end relationship across hinged joints formed by scored lines. Two alternating ones of the wall panels have associated inner closure flaps extending laterally from opposite sides thereof. Outer closure flaps are hingedly connected to and extend laterally from opposite sides of the other two wall panels. Tabs are associated with and extend from each of the closure flaps and on end ones of the wall panels are formed such that a portion of each associated flap which is adjacent to an end of the blank extends laterally at least to a free outer end surface of the associated tab. In this way, edge surfaces which are of substantial length and which are normal to each other are provided at ends of the formed blank to facilitate the accurate scoring of lines to provide the hinged connections between the wall panels, between the wall panels and the inner and outer flaps and between the inner and outer flaps and associated tabs.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
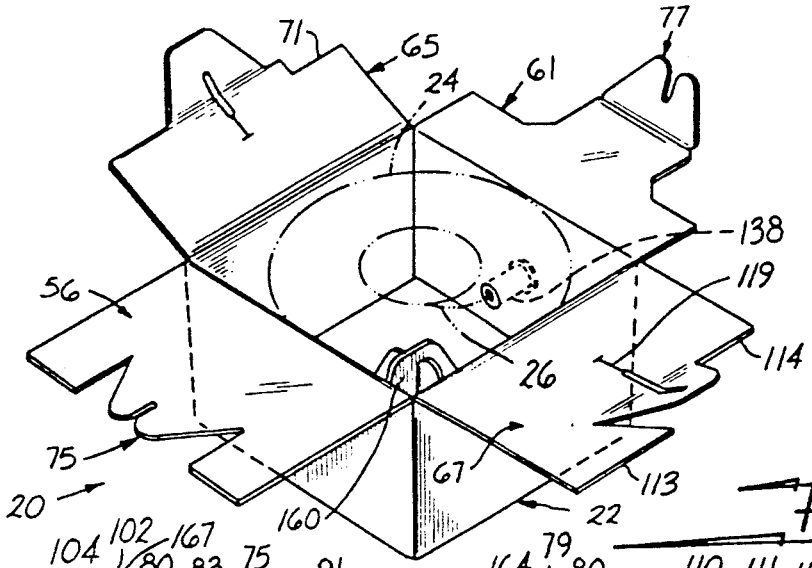
FIG. 1 is a perspective view of a partially assembled package of coiled elongated strand material of this invention.

Referring now to FIG. 1, there is shown a package 20 of coiled strand material. The package 20 includes a container or carton 22 and a coil 24 of elongated strand material 26 disposed within the carton. The strand material may be a communications wire, for example, which includes a plurality of pairs of insulated conductors, for example, which are enclosed in a jacket.

Figure 2:
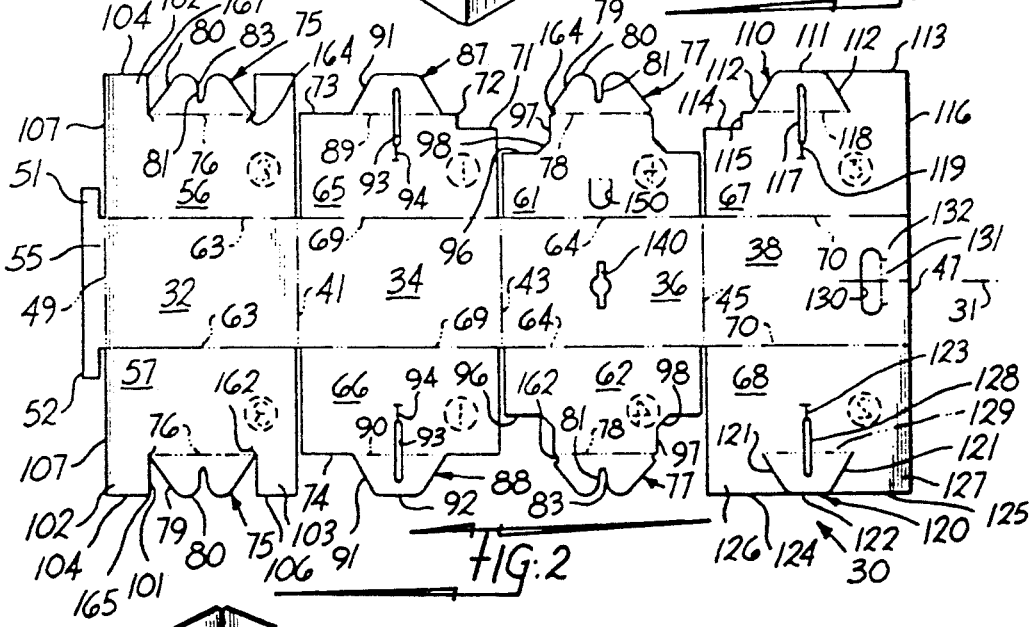
FIG. 2 is a plan view of a formed, scored blank from which a carton of the package of FIG. 1 is assembled.

The carton 22 is assembled from a length of corrugated fiberboard material for example which is formed by punch and die apparatus (not shown) into a formed or cut blank 30 (see FIG. 2) being in strip form and having a longitudinal axis 31. The view of FIG. 2 is taken of those major surfaces of the blank which are destined to form inner surfaces of the carton. As can be seen, the formed blank 30 includes four wall panels 32, 34, 36 and 38 which may be referred to referred to as first, second, third, and fourth wall panels and which are interconnected through hinged connections 41, 43 and 45. The hinged connections 41, 43 and 45 are formed by scoring the blank and may be referred to as scored lines. An outer end surface of the wall panel 38 is designated by the numeral 47 whereas an outer edge portion 49 of the wall panel 32 has a T-shaped portion 51 extending therefrom. The T-shaped portion 51, which is referred to as a joint flap, includes a head portion 52, connected through a stem 55 to the edge portion 49 of the wall panel 32. The longitudinal axis 31 extends along the center of each wall panel and is normal to end edge surfaces of the wall panels.

Outer closure flaps 56 and 57 are hingedly connected through scored lines 63—63 to the wall panel 32 and outer closure flaps 61 and 62 are hingedly connected through scored lines 64—64, respectively to the wall panel 36. Inner closure flaps 65,66 and 67,68 also are provided. The inner closure flaps 65 and 66 are hingedly connected along scored lines 69—69 to each of opposed side edge surfaces of the wall panel 34 whereas the inner closure flaps 67 and 68 are hingedly connected along scored lines 70—70 to each of opposed side edge surfaces of the wall panel 38.

The inner closure flap 65 is formed with a step 71. The step 71 is connected through a riser 72 to an outer edge surface 73 of the inner closure flap 65. The inner closure flap 66 includes an outer edge surface 74.

Also, as seen in FIGS. 1 and 2, the formed blank 22 is provided with tabs to facilitate the assembly of the carton. As can be seen, tabs 75—75 are hingedly connected along scored lines 76—76 to and extend laterally from the outer closure flaps 56 and 57. Similarly, tabs 77—77 are connected hingedly along scored lines 78—78 to opposed side edge surfaces of the outer closure flaps 61 and 62.

Each of the tabs 75—75 and 77—77 includes inclined side edge surfaces 79—79 and arcuately shaped outer edge surface portions 80—80. The arcuately shaped outer edge surface portions terminate in edge surface portions 81—81 which form an open ended slot 83. As can be seen best in FIG. 2, each of the slots 83—83 extends in a direction normal to the longitudinal axis 31 of the blank from the free end of a tab to a point which is spaced from the scored lines 76—76 and 78—78 of the hinged connections.

The inner closure flaps 65,66 and 67,68 also are provided with tabs. Extending from opposed side edge surfaces 73 and 74 of the inner closure flaps 65 and 66 are tabs 87 and 88, respectively. Each of the tabs 87 and 88 is connected hingedly along a scored line, 89 and 90, respectively, to its associated inner closure flap. As also can be seen, each of the tabs 87 and 88 has a generally trapezoidal configuration which includes inclined edge surfaces 91—91 and an outer edge surface 92 which is parallel to the longitudinal axis 31.

The formed blank also includes internally formed slots 93—93. Each of the slots 93—93 extends in a direction which is normal to the longitudinal axis 31 of the blank from within a tab 87 or 88 to a location within the associated inner closure flap. A slit 94 extends from an inner end of each slot 93 toward a scored line 69.

When the tabs 87 and 88 are folded along their hinged connection lines 89 and 90, a portion of each of the slots 93—93 is located in a tab 87 or 88 and a portion in its associated closure flap 65 or 66. The portion of each slot 93 in the flaps is somewhat longer to accommodate portions of the bases of the tabs of the outer closure flaps when the tabs of the outer closure flaps are inserted into the slots 93—93.

Also, it should be observed that although outer free edge surfaces of all the tabs are aligned along a line parallel to the axis 31, edge portions 96—96 of the flaps 61 and 62 are recessed from outer edge surface of the contiguous flaps. Further, the edge surfaces 96—96 are joined to edge surfaces 97—97 of the flaps 61 and 62 through inclined edge surfaces 98—98. The inclined edge surfaces 98—98 are helpful in securing together portions of the package.

In at least one end portion of the blank 30, it is important to recognize that the outer closure flaps 57 and 58 and associated tabs are configured in a way which facilitates the manufacture of the blank. As is seen, each tab 75 which extends from an outer closure flap connected to the wall panel 32 is formed within a window 101 formed along an outer portion of each of the outer closure flaps 56 and 57. As a result, after each tab 75 is formed, the associated outer closure flap includes spaced portions 102 and 103 which border the tab and which extend laterally from the closure flap at least as far as the tab 75. As is seen, outer edge surfaces 104 and 106 are collinear and normal to end edge surfaces 107—107 of the closure flaps 56 and 57.

An opposite end of the blank 30 is formed somewhat differently. Going first to the inner closure flap 67, it is seen that a tab 110 having a trapezoidal configuration is formed in the flap such that an outer edge surface 111 of the flap which is joined to inclined edge surfaces 112—112 is collinear with an outer edge surface 113 of the flap which is normal to an end edge surface 116. The outer edge surfaces 111 and 113 are aligned with outer edge surfaces of the tabs 75, 87 and 77 which are hingedly connected to the flaps 56,65 and 61, respectively, and with the edge surfaces 104 and 105 of the flap 56 along a line which is parallel to the longitudinal axis 31. As can be seen in FIG. 2, the outer closure flap 67 also has a step 114 formed therein which connects through a riser 115 to a scored line 118 which connects the tab 110 to the flap 67. Also formed in the flap 67 is a slot 117 which extends from a location within the tab 110 across the scored line 118 which hingedly connects the tab 110 to the inner closure flap 67 and terminates at a location within the flap spaced from the scored line 70. A slit 119 extends from the slot 117.

On an opposed side of the blank at the wall panel 38 end thereof and formed in the inner closure flap 68 is a tab 120. As with the tab 110, the tab 120 has a trapezoidal configuration with inclined edge surfaces 121—121 joined to an outer edge surface 122. The outer edge surface 122 is collinear with outer side edge surfaces 124 and 125 of portions 126 and 127 of the inner closure flap 68. The outer edge surfaces 124 and 125 are normal to the end edge surface 116 of the inner closure flaps 67 and 68 and the outer edge surface 47 of the wall panel 38. Also, the outer edge surfaces 124 and 125 are aligned with outer edge surfaces of the tabs 75, 88 and 77 of the closure flaps 57, 66 and 62, respectively, and with the edge surfaces 104 and 105 of the flap 57 along a line which is parallel to the longitudinal axis 31.

Also as can be seen, a slot 128 is formed to extend from within the tab 120 to a location within the inner closure flap 68. In so doing, it crosses a scored line 129 which connects hingedly the tab 120 to the inner closure flap 68. A slit 123 extends from an inner end of the slot 128 toward the adjacent scored line 70.

As a result of the configuration of the end ones of the closure flaps and tabs, once the blank 30 is cut and formed, it may be positioned in apparatus (not shown) along guide surfaces which are normal to each other and which engage the end surfaces 107 and 116 as well as the edge surfaces 104 and 106 at one end and 113 and 124,125 at an opposite end to obtain scored lines which are normal or parallel to the end edge surfaces and which are parallel or normal to the longitudinal axis 31. When the fold lines are scored, the lines are parallel or normal to one another resulting in a carton having a substantially right angled parallelpiped configuration after assembly.

The blank 30 also is provided with a hand hole 130 which is oblong and which may be used to move the carton. The hand hole 130 is provided with an extension 131 by forming two slits 132—132 in a direction transverse of the end edge surface 47 of the wall panel 38. As such, the slits are normal to corrugation flutes of the corrugated fiberboard material of which the blank 30 is made. Also, ends of the slits abut the joint flap 51 after the end wall panels are connected together. This provides added strength for the portion of the blank in which the hand hole is formed.

In order to pay out the strand material 26 from within the container, a tube 138 (see FIG. 1) is inserted through an opening 140 of the container. Such a tube is known in the art and may be one disclosed, for example, in U.S. Pat. No. 4,057,204.

As further shown in FIG. 2, the blank includes a window 150 which when the carton is assembled is exposed because it remains uncovered by ones of the flaps. The window enables an installer, for example, to view the interior of the coil of elongated strand material.

Figure 3:
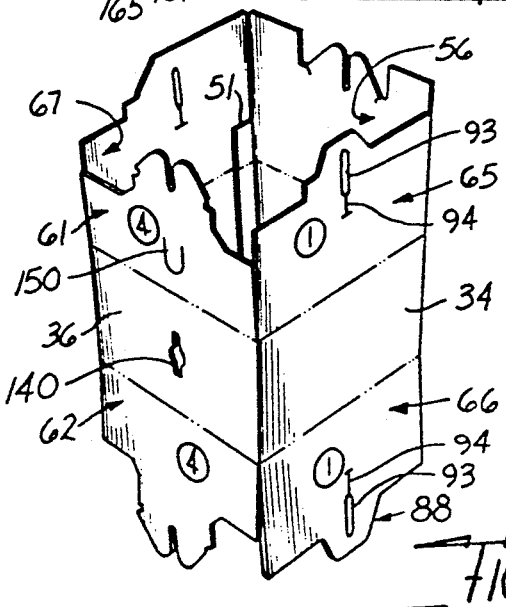
FIG. 3 is a perspective view of a first step in the assembly of the carton from the blank shown in FIG. 2.
Figure 4:
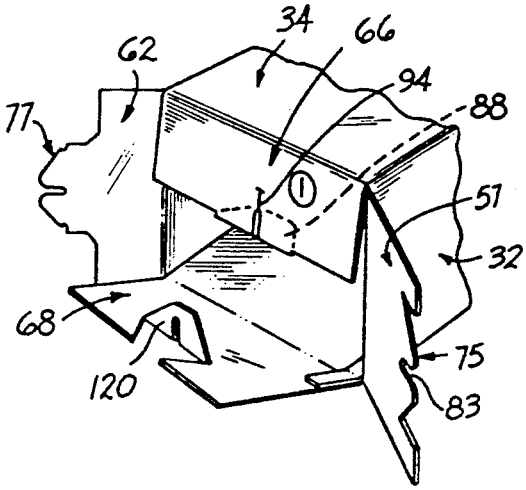
FIGS. 4–12 are perspective views depicting subsequent steps in the assembly of the package of this invention.
Figure 5:
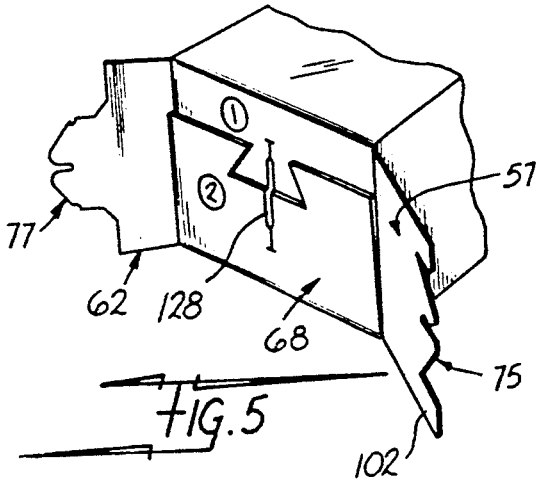

The blank 20 is assembled into the carton which is depicted in FIG. 1. With the blank 30 oriented as shown in FIG. 2, the wall panels are folded along the hinged connections thereof to form the configuration shown in FIG. 3 utilizing the joint flap 51 to secure the structure. This step may be taken by the manufacturer of the carton blank. Next, the inner closure flap 66 is folded inwardly followed by the inner closure flap 68 (see FIG. 4). It should be observed from FIG. 2 that an outer surface of each of the flaps or tabs is marked with a numeral 1, 2, 3 or 4 within a circle. These numerals provide a sequence to a production technician to the sequence of folds of the inner and outer closure flaps, the sequence being in numerical order, first on one side of the longitudinal axis to provide a bottom for the carton, and then in the opposite side to provide a top. The tabs 88 and 120 of the closure flaps 66 and 68, respectively, also are folded inwardly further to positions substantially at a right angle to the closure flaps. As such, the tabs 88 and 120 abut each other and extend into the interior of the carton (see FIG. 5) with portions of the slots 93 and 128 being aligned.

Figure 6:
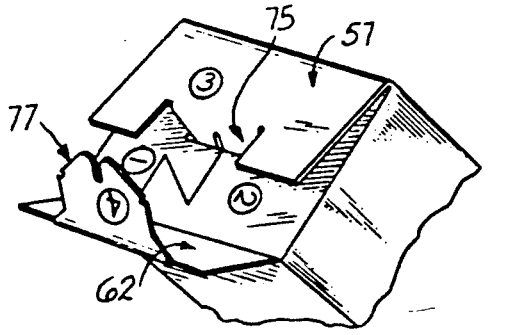

Then the outer closure flaps 57 and 62 are folded inwardly (see FIG. 6) with the tabs thereof, tabs 75 and 77, respectively, turned further inwardly into the slots 93 and 128 and the slit extensions 94 and 123 thereof. This movement is continued until the closure flaps 57 and 62 engage the inner closure flaps 66 and 68 and the tabs thereof extend through the slots 93 and 128 and the slits 94 and 123 (see FIG. 7) into the interior of the carton and abut each other. The abutting tabs 88 and 120 cooperate with the abutting tabs 75 and 77 to form a cone 160 extending inwardly of the carton from a bottom of the carton as viewed in FIGS. 1 and 8. This cone as well as one to be formed when portions of the blank are caused to provide a top extend into an open center of the coil of strand material to be loaded into the carton.

Locking features of the carton are important. As is seen in FIG. 1, each of the tabs 75 and 77 extends from its associated scored hinge line 63 or 64 through a neck portion which provides a recess 162. When the tabs 75 and 77 are inserted fully into the slots 93 and 128 and the slits 94 and 123 associated therewith, edge surfaces at ends of the slots and the slits lock into surfaces which define the recesses 162—162 at opposite ends of the tabs 75 and 77. This arrangement causes the tabs 75 and 77 and hence the tabs of the underlying inner closure flaps 66 and 68 to be held within the slots 93 and 128.

Figure 7:
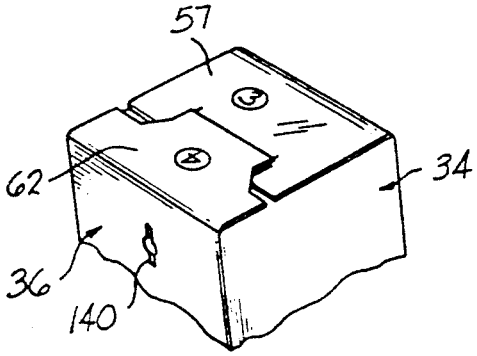
Figure 8:
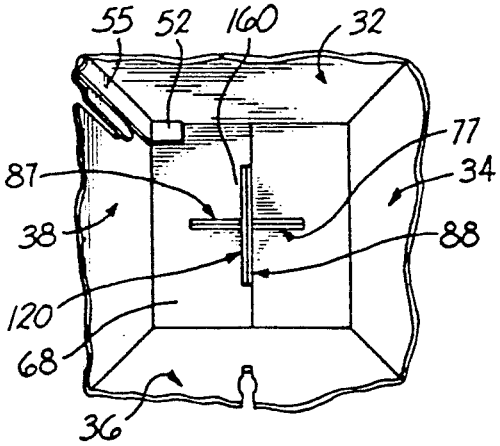

Also, as can be seen in FIG. 7, when the flap 62 is folded into the position shown, the inclined edge surfaces 98—98 thereof overlap corners 165—165 of portions 102 and 103 of the flap 57. This causes the portions 126 and 137 of the flap 68 to be held in the position.

With the carton partially assembled, a production technician positions a coil 24 of the elongated strand material 26 into the partially assembled carton so that the open center thereof is disposed over the cone 160. The coil is rotated in this position until the payout tube which was inserted through the body of the coil either at the time of winding or subsequent thereto is aligned with and adjacent to the opening 140 in the wall panel 36. Then the payout tube 138 such as that described in the priorly identified patent is caused to be secured to the wall panel 61 in which is formed the opening 144. An inner end of the strand material then is fed into the payout tube (see FIG. 1) and secured in a suitable manner to the outer flange of the tube.

Figure 9:
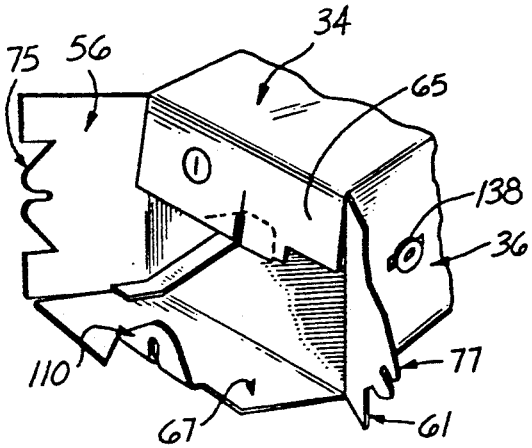
Figure 10:
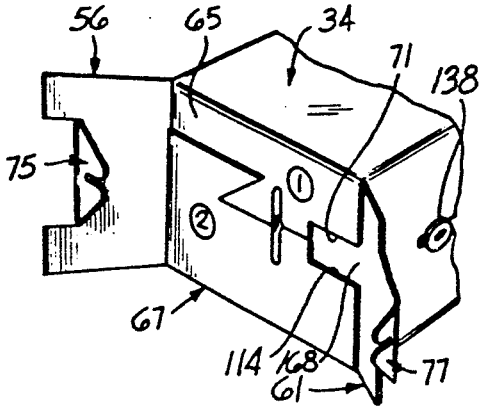

Afterwards, the carton 22 is closed to complete the package 20. Inner closure flaps 65 and 67, respectively are turned inwardly and the tabs 87 and 110 associated therewith folded over and extended into the center opening in the coil of elongated stand material (see FIGS. 9 and 10). As the inner closure flaps are folded over, stepped portions 71 and 114 of the outer closure flaps 65 and 67, respectively, are aligned with each other. Subsequently, the outer closure flaps 56 and 61 are folded inwardly by turning them about the scored lines 63 and 64, respectively. The tabs 75 and 77 associated with the outer closure flaps are turned about their scored lines 76 and 78, respectively.

Figure 11:
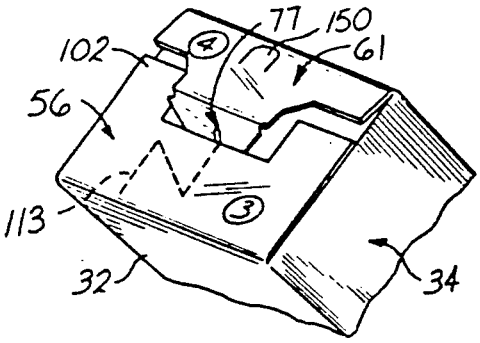
Figure 12:
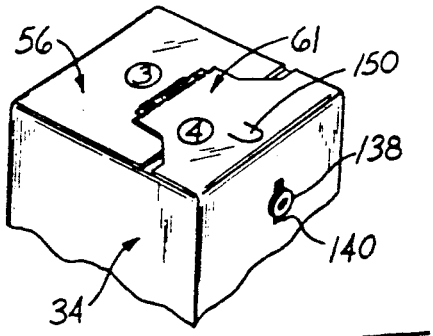

Also, as the outer closure flaps 56 and 61 are folded over, the tabs thereof are inserted into the slots 93 and 117 of the inner closure flaps which are already in position. As the tabs are inserted, the tabs extend through the portions of the slots 93 and 117 which are formed in the inner closure flaps and also through the slits 94 and 119 extending from the slots (see FIG. 11). When the outer closure flaps are substantially in engagement with the inner flaps, radiused portions 164—164 of the inclined edge surfaces 79 and 80 ride over the ends of the slits and undercut portions lock in at the edge surfaces defining the ends of the slits to secure the outer closure flaps and to complete the package (see FIG. 12). Also, inclined portions 98—98 of the flap 61 overlap corners 167—167 of the portions 102 and 103 of the flap 56 to secure the portions 102 and 103.

As the carton closure flaps 56 and 61 are folded over and the tabs 75 and 77 thereof inserted into the slots 93 and 117 and the slit extensions thereof, the window 150 becomes aligned (see FIG. 11) with an opening 168 (see FIG. 10) formed by the steps 71 and 114 to enable viewing of an interior of the package.

Figure 13:
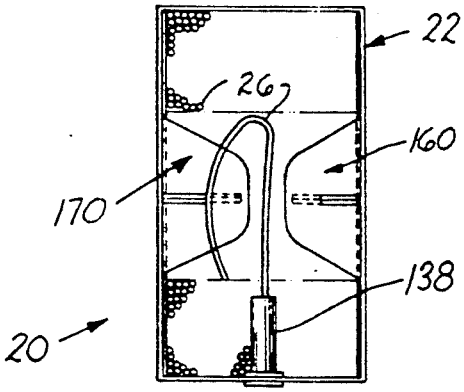
FIG. 13 is an end sectional view of an assembled package of this invention.

The folding of the tabs 87 and 110 to positions at right angles to the inner closure flaps 65 and 67 and the subsequent insertion of the tabs 75 and 77 into the slits 93 and 117 form a second cone 170 (see FIG. 13). The cone 170 extends into the open center portion of the coil of strand material in the assembled carton. As a result, the coil 24 is held within the carton to facilitate payout of the strand material through the tube 138.

The assembled carton of the package 20 is such that the flaps and the wall panels thereof are substantially perpendicular to each other as are the tabs to the flaps. As a result, cartons assembled from blanks 30—30 are easier to stack. Such a result is accomplished because in the blank 30, as cut, and scored, and shown in FIG. 2, end ones of the flaps in the strip of panels and flaps have edge surfaces which are parallel to the longitudinal axis 31. Edge surfaces 104 and 106 are perpendicular to the outer free edge surface 107. At the other end of the blank 30, an edge surface 113 is normal to the edge surface 116. Also, surfaces 124 and 125 adjacent to the tab 120 are normal to the edge surface 116.

Figure 14:
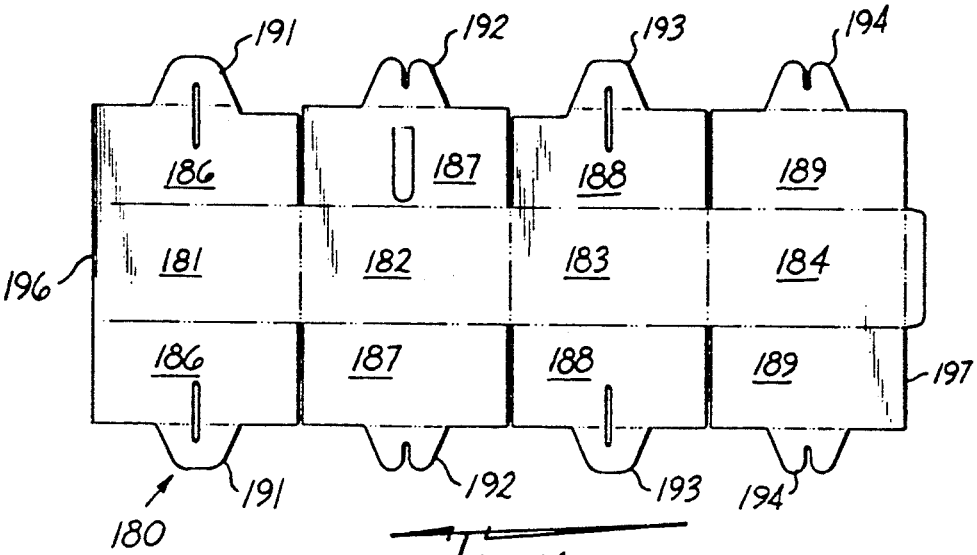
FIG. 14 PRIOR ART
FIG. 14 is a plan view of a carton blank of the prior art.

This contrasts with a blank 180 of the prior art which is shown in FIG. 14. As can be seen, four wall panels 181, 182, 183 and 184 are joined end to end. Closure flaps 186—186 extend from the wall panel 181, 187—187 from the panel 182, 188—188 from the panel 183 and 189—189 from the panel 184. Tabs 191—191 extend from the flaps 186—186, 192—192 from the flaps 187—187, tabs 193—193 from the flaps 188—188 and tabs 194—194 from the end flaps 189—189. At the ends of the blank 180, there are insufficient lengths of guide surfaces which are normal to end edge surfaces 196 and 197 to square up accurately the carton blank for a scoring operation. Unlike in the carton of this invention, the tabs 191—191 and 194—194 extend beyond edge surfaces of their associated end flaps and because of their configuration do not provide the edge surfaces required as guides during the scoring operation. As a result, the scored lines may not all be substantially parallel or normal to the longitudinal axis of the blank 180, resulting in an undesired level of scrap.

It is to be understood that the above-described arrangements are simply illustrative of the invention. Other arrangements may be devised by those skilled in the art which will embody the principles of the invention and fall within the spirit and scope thereof.

I claim:

1. A package of coiled, elongated strand material which comprises:

a coil of elongated strand material which is capable of being payed out from an interior of the coil without rotation of the coil; and a carton in which is disposed said coil, said carton including a plurality of wall panels which confine laterally said coil with each said wall panel having opposed flaps and an associated tab which is located along an edge portion of each of said flaps opposite a hinged connection of the flap to an associated wall panel and with the tabs of the flaps on each of two opposing sides of said wall panels being interlocked to form a member extending into a portion of the coil to facilitate payout of the elongated strand material, and said carton having been assembled from a blank which has a longitudinal axis and which includes said wall panels in interconnected end to end relation in a strip such that said wall panels are connected together with each of flaps associated with each of end ones of said wall panels in said blank having a portion which extends at least to a free outer end of the tab that is associated with each said end one of said flaps and which has an end edge surface that is perpendicular and intersects with to an end edge surface of the blank.

2. The package of claim 1, wherein said carton includes four wall panels.

3. The package of claim 2, wherein the wall panels are first, second, third and fourth wall panels connected in the strip, wherein connected to each of the second and fourth of the wall panels in the strip are oppositely extending inner closure flaps and connected to the first and third wall panels which alternate with the second and fourth panels, to which said inner closure flaps are connected, are connected oppositely extending outer closure flaps, wherein the fourth one of said two wall panels to which two inner closure flaps are connected is an end one of the wall panels in the strip and wherein a first one of said wall panels to which outer closure flaps are connected is an end one the wall panels in the strip.

4. The package of claim 3, wherein each of said tabs of each of said second and fourth wall panels to which are connected inner closure flaps includes a slot which extends in a direction normal to the longitudinal axis of the blank with a portion of each slot being disposed in a tab and a portion being disposed in the inner closure flap to which the tab is hingedly connected.

5. The package of claim 4, wherein each of said inner closure flaps is provided with a slit which extends in a direction normal to the longitudinal axis of said blank from the portion of the slot formed in an inner closure flap toward the longitudinal axis.

6. The package of claim 5, wherein each of the first and third wall panels has connected hingedly thereto an outer closure flap having an associated tab which has a generally trapezoidal shape having inclined side edge surfaces each of which is connected to an arcuately shaped edge surface of the tab, each said arcuately shaped edge surface of a tab associated with an outer closure flap being joined to an edge surface which extends in a direction normal to the longitudinal axis to define a slot which is formed in the tab of the associated outer closure flap and which opens to a free end of the tab of the associated outer closure flap.

7. The package of claim 6, wherein one of said inner closure flaps of the fourth end wall panel has a portion which is adjacent to an end edge surface of said one inner closure flap and which extends in a direction normal to the longitudinal axis at least to a free end edge surface of the tab associated with said one inner closure flap.

8. The package of claim 7, wherein the other one of said inner closure flaps of the fourth end wall panel has a free outer end edge surface which is parallel to said longitudinal axis, which is perpendicular to said end edge surface of said fourth wall panel and which is interrupted by cuts in said blank to have provided therein a tab which is associated with the other one of said inner closure flaps of the fourth end wall panel and which has a free end edge surface that is collinear with the free outer end edge surface of said other one of said inner closure flaps of said fourth wall panel and with free outer end edge surfaces of an outer closure flap of said first wall panel.

9. The package of claim 8, wherein each of said outer closure flaps of the third wall panel which is disposed between the wall panels to which said inner closure flaps are connected is provided with spaced apart free outer edge surface portions which are recessed from a scored line through which each associated tab is connected to a closure flap of said third wall panel, each said free outer edge surface portion of each outer closure flap of said third wall panel being parallel to the longitudinal axis and connected to an edge surface which is inclined to the longitudinal axis and which is connected to an edge surface that is normal to the longitudinal axis and connected to the associated tab.

10. The package of claim 9, wherein the third wall panel to which is connected two of said outer closure flaps and which is disposed between the two of the wall panels to which are connected inner closure flaps has an opening formed therein, said package also including a tube which extends through said opening and through which the elongated strand material is payed out.

11. The package of claim 10, wherein said one of said outer closure flaps which is connected hingedly to the third wall panel which is disposed between the two wall panels to which said inner closure flaps are connected includes a window which facilitates inspection of the interior of said package.

12. The package of claim 9, wherein the first one of the wall panels includes two outer closure flaps hingedly connected thereto with each one of said outer closure flaps having an outer portion having an edge surface which is parallel to the longitudinal axis and which is aligned with outer edge surfaces of tabs associated with the second, third and fourth wall panels, said edge surface of each outer flap associated with said first wall panel being interrupted to provide a recess in which is formed a tab, each said tab associated with an outer closure flap of said first wall panel being hingedly connected to its associated outer closure flap along a line parallel to the longitudinal axis, having a generally trapezoidal shaped configuration, and having a free outer arcuately shaped edge surface which is aligned with outer edge surfaces of the tabs associated with said second, third and fourth wall panels.

13. The package of claim 12, wherein in the carton, the inclined edge surfaces of the outer closure flaps of the third wall panel overlap outer portions of the outer closure flaps of the first wall panel to hold said outer closure flaps of the first wall panel in a position that is substantially perpendicular to the wall panels.

14. A blank from which a carton may be assembled, said blank comprising a plurality of wall panels which are adapted to confine laterally a coil of elongated stand material with each said wall panel having opposed flaps and an associated tab which is located along an edge portion of each of said flaps opposite a hinged connection of the flap to an associated wall panel and with the tabs of said flaps on each of two opposing sides of said wall panel being adapted to be interlocked to form a member to extend into a portion of a coil to facilitate payout of the elongated strand material, said blank including said wall panels in interconnected relation in a strip with each of said flaps associated with each of end ones of said wall panels in said blank having at least one portion which extends at least to a free outer end of the tab that is associated with each said end one of said flaps and which has an end edge surface that is normal to and intersects with an end edge surface of the blank.

15. The blank of claim 14, wherein said carton includes four wall panels.

16. The blank of claim 15, wherein the wall panels are first, second, third and fourth wall panels connected in the strip, wherein connected to each of the second and fourth of the wall panels in the strip are oppositely extending inner closure flaps and connected to the first and third wall panels which alternate with the second and fourth panels, to which said inner closure flaps are connected, are connected oppositely extending outer closure flaps, wherein the fourth one of said two wall panels to which two inner closure flaps are connected is an end one of the wall panels in the strip and wherein a first one of said wall panels to which outer closure flaps are connected is an end one the wall panels in the strip.

17. The blank of claim 16, wherein each of said tabs of each of said second and fourth wall panels to which are connected inner closure flaps includes a slot which extends in a direction normal to the longitudinal axis of the blank with a portion of each slot being disposed in a tab and a portion being disposed in the inner closure flap to which the tab is hingedly connected.

18. The blank of claim 17, wherein each of said inner closure flaps is provided with a slit which extends in a direction normal to the longitudinal axis of said blank from the portion of the slot formed in an inner closure flap toward the longitudinal axis.

19. The blank of claim 18, wherein each of said first and third wall panels has connected hingedly thereto an outer closure flap having a tab which has a generally trapezoidal shape having inclined side edge surfaces each of which is connected to an arcuately shaped edge surface of the tab, each said arcuately shaped edge surface of a tab associated with an outer closure flap being joined to an edge surface which extends in a direction normal to the longitudinal axis to define a slot which is formed in the tab of the associated outer closure flap and which opens to a free end of tab.

20. The blank of claim 19, wherein one of said inner closure flaps of the fourth end wall panel has a portion which is adjacent to an end edge surface of said one inner closure flap and which extends in a direction normal to the longitudinal axis at least to a free end edge surface of the tab associated with said one inner closure flap.

21. The blank of claim 20, wherein the other one of said inner closure flaps of the fourth end wall panel has a free outer end edge surface which is parallel to said longitudinal axis, which is perpendicular to said end edge surface of said fourth wall panel and which is interrupted by cuts in said blank to have provided therein a tab which is associated with the other one of said inner closure flaps of the fourth end wall panel and which has a free end edge surface that is collinear with the free outer end edge surface of said other one of said inner closure flaps of said fourth wall panel and with free outer end edge surfaces of an outer closure flap of said first wall panel.

22. The blank of claim 21, wherein each ~~of~~ said outer closure flaps of the third wall panel which is disposed between the wall panels to which said inner closure flaps are connected is provided with spaced apart free outer edge surface portions which are recessed from a scored line through which the associated tab is connected to a closure flap of said third wall panel, each said free outer edge surface portion of each outer closure flap of said third wall panel being parallel to the longitudinal axis and connected to an edge surface which is inclined to the longitudinal axis and which is connected to an edge surface that is normal to the longitudinal axis and connected to the associated tab.

23. The blank of claim 22, wherein the first one of the wall panels includes two outer closure flaps hingedly connected thereto with each one of said outer closure flaps having an outer edge surface which is parallel to the longitudinal axis and which is aligned with outer edge surfaces of tabs associated with the second, third and fourth wall panels, said edge surface of each outer flap associated with said first wall panel being interrupted to provide a recess in which is formed a tab, each said tab associated with an outer closure flap of said first wall panel being hingedly connected to its associated outer closure flap along a line parallel to the longitudinal axis, having a generally trapezoidal shaped configuration and having a free outer arcuately shaped edge surface which is aligned with outer edge surfaces of the tabs associated with said second, third and fourth wall panels.

* * * * *